United States Patent [19]

Stockman et al.

[11] 4,040,475

[45] Aug. 9, 1977

[54] AXIALLY MOVABLE SECTOR PLATE SUPPORT FOR ROTARY REGENERATIVE HEAT EXCHANGER

[75] Inventors: Richard Franklin Stockman, Friendship; Roderick Jay Baker, Belmont, both of N.Y.

[73] Assignee: The Air Preheater Company, Inc., Wellsville, N.Y.

[21] Appl. No.: 704,705

[22] Filed: July 12, 1976

[51] Int. Cl.[2] ..... F28D 19/00

[52] U.S. Cl. ..... 165/9

[58] Field of Search ..... 165/9

[56] References Cited

U.S. PATENT DOCUMENTS

| | | | |
|---|---|---|---|
| 2,666,624 | 1/1954 | Flurschutz | 165/9 |
| 3,010,703 | 11/1961 | Bellows et al. | 165/9 |
| 3,786,868 | 1/1974 | Finnemore | 165/9 |
| 3,822,739 | 7/1974 | Kurschner | 165/9 |
| 3,980,128 | 9/1976 | Stockman | 165/9 |

*Primary Examiner*—Albert W. Davis, Jr.
*Attorney, Agent, or Firm*—Wayne H. Lang

[57] ABSTRACT

Rotary regenerative heat exchange apparatus having a rotor of heat absorbent material that is alternately exposed to hot and cold fluids in order that heat from the hot fluid may be transferred to the cold fluid through the intermediary of the heat absorbent material. The rotor is surrounded by a housing including sector plates that cooperate with a rotor post seal at opposite ends of the rotor to separate the several fluids. A unique support for the sector plate and the rotor post seal is adapted to move axially while permitting radial expansion effected by thermal variations of the rotor to provide an optimum sealing arrangement.

7 Claims, 2 Drawing Figures

AXIALLY MOVABLE SECTOR PLATE SUPPORT FOR ROTARY REGENERATIVE HEAT EXCHANGER

BACKGROUND OF THE INVENTION

In rotary regenerative heat exchange apparatus a mass of heat absorbent material commonly comprised of packed element plates is positioned in a hot gas passageway to absorb heat from hot gases passing therethrough. After the plates become heated in the hot gas stream, they are moved into a cool air passageway where the heated plates transmit their heat to a stream of cooler air or other fluid passing therethrough.

The heat absorbent material is carried by a rotor in a rotor shell and surrounded by fixed housing structure that includes sector plates at opposite ends thereof arranged to separate the hot gas from the cooler air. To prevent mingling of the hot and cool fluids, the end edges of the rotor are usually provided with flexible sealing members that extend axially to the adjacent surface of the surrounding rotor housing while flexible sealing means surround the central rotor post to resiliently accommodate a limited amount of expansion and contraction that accompanies thermal variations of the rotor.

Arrangements have been devised whereby the sector plates are supported at their inboard ends on axially movable supports in the manner shown by U.S. Pat. No. 3,786,868 and U.S. Pat. No. 3,010,703. In no instance, however, has it been shown or even suggested that rotor post sealing means, as well as the inboard ends of the sector plates, be moved axially together to provide continuous sealing and an optimum sealing arrangement throughout a wide range of expansion and contraction of the relatively movable parts.

SUMMARY OF THE INVENTION

In accordance with the invention, therefore, I provide a unique support for the inboard ends of the sector plates that permits simultaneous movement thereof in both a radial and an axial direction. Moreover, the invention includes a sealing arrangement for the rotor post that is also movable along the axis thereof to at all times provide an optimum sealing arrangement that precludes fluid flow between the rotor and the surrounding housing structure.

THE SPECIFICATION

Figure 1:
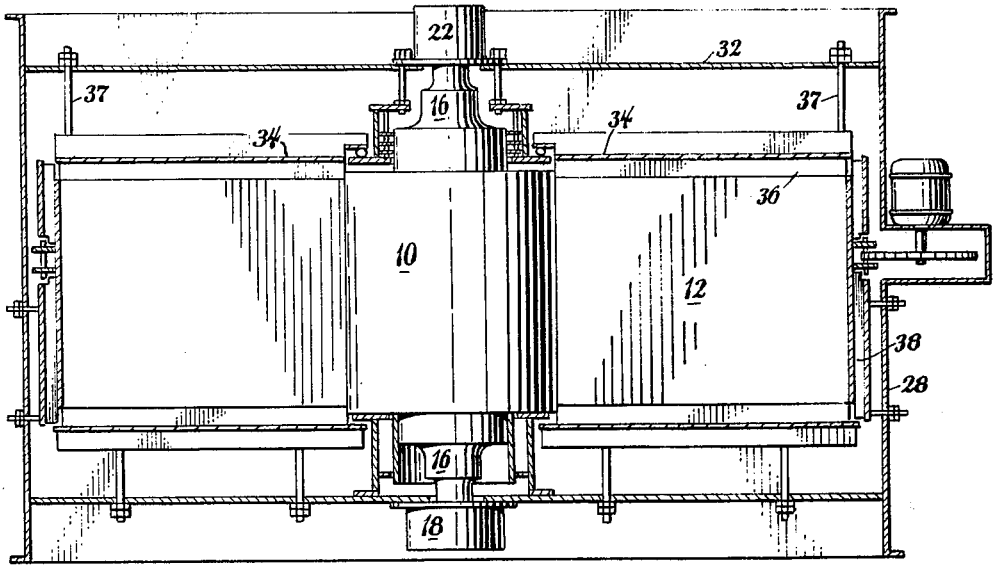
FIG. 1 is a cross-section of a rotary regenerative heat exchange embodying the invention.
Figure 2:
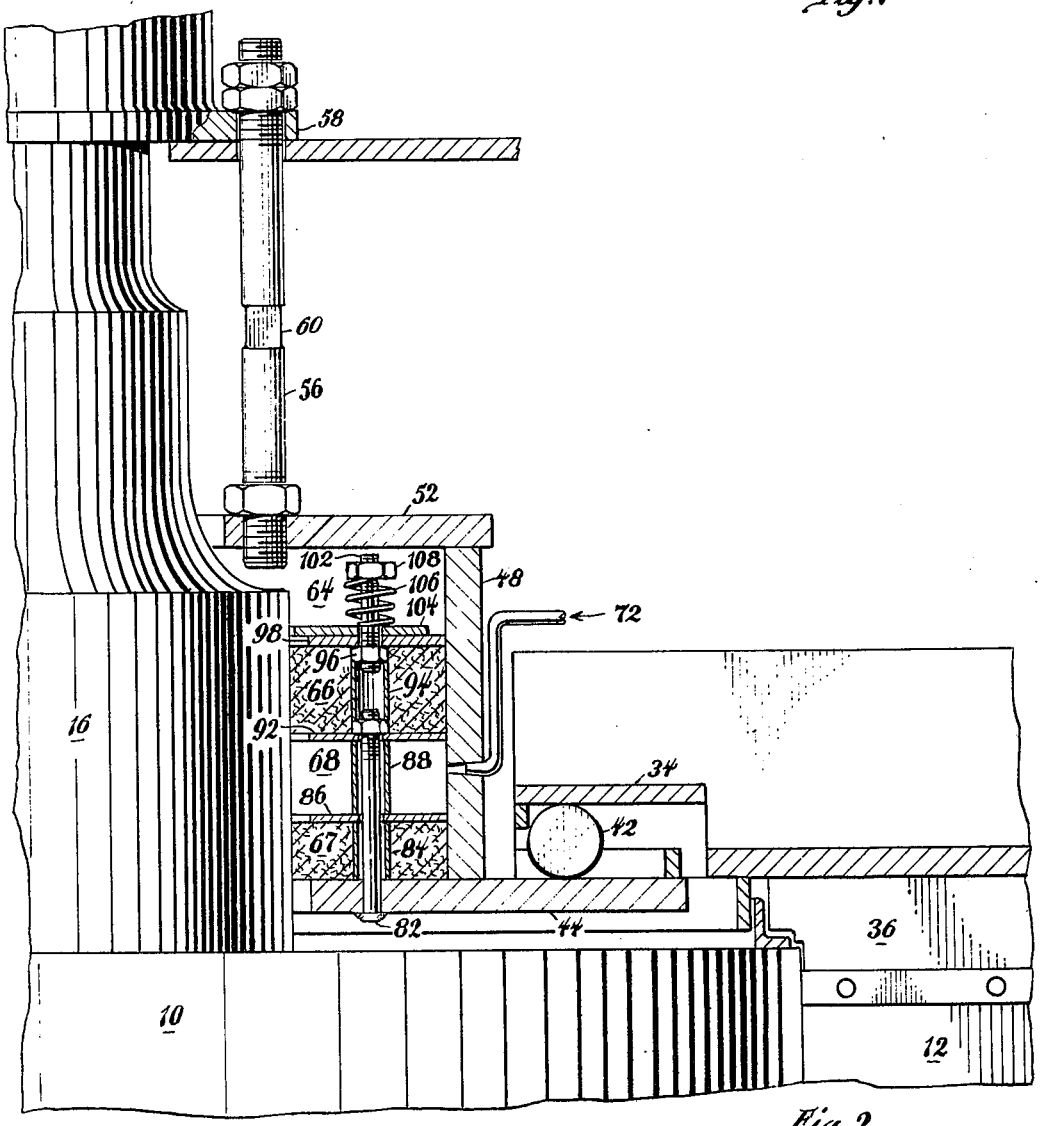
FIG. 2 is an enlarged cross-sectional view showing the details of the unique rotor seal and movable sector plate support.

In the drawings a cylindrical rotor formed concentrically around a central rotor post 10 rotates a mass of heat absorbent material 12 between a cool fluid and a hot fluid. The rotor post 10 includes trunnion means 16 at opposite ends thereof supported by thrust bearing 18 and maintained upright by a guide bearing 22 and rotated about its axis by any convenient driving means.

The rotor is surrounded by a rotor housing 28 that includes connecting plates 32 at opposite ends thereof having apertures that permit the hot and cool fluids to flow through the heat absorbent material carried by the rotor.

To prevent the intermingling of said fluids as they pass through the heat exchanger, sector plates 34 are provided at the ends of the housing and adapted to lie in sealing relation with the radial seals 36 carried by the ends of the rotor. The sector plates are supported at their outboard ends on hangers 37 that lie at the ends of the rotor normal to axial seals 38 to preclude the flow of fluid past the rotor. The inboard end of each sector plate 34 is supported on a roller 42 that rests directly on annular flange 44. By this arrangement, any expansion or contraction of a sector plate as effected by thermal variation will be easily accommodated by an unrestricted radial movement on the roller 42.

The roller 42 is carried by annular flange 44 connected to the lower end of cylindrical sleeve 48 concentric with the rotor post 12. The upper end of sleeve 48 carries a plurality of angularly spaced ears 52 that are drilled and threaded to receive hangers 56 that depend from the bearing housing 58. The bearing housing is in turn carried by the end of the trunnion that is free move axially in response to thermal variations. The hangers 56 are provided with a flat section 60 to enable them to be turned into the threaded openings of ears 52.

To preclude any flow of fluid through annular space 64 between the trunnion and surrounding sleeve 48 it is packed with material forming a resilient filling that permits relative movement therebetween. The space is preferably divided by a plurality of resilient sealing rings 66 and 67 having an annular void 68 therebetween that is pressurized with compressed air from a supply duct 72. Inasmuch as the air in space 68 is maintained at a pressure greater than that within the heat exchanger, there can be no leakage outward through this space to the ambient atmosphere. Moreover, the resilient sealing ring 66 has a greater resistance to fluid flow therethrough than has sealing ring 67 whereby any leakage from space 68 would flow back through the path of least resistance to the interior of the air preheater, rather than through the sealing ring 66 to the atmosphere.

The arrangement by which the resilient sealing rings 66 and 67 are held in their respective compartments has been designed to permit ease of access thereto. Thus, a plurality of studs 82 are adapted to extend upward from the inner periphery of annular flange 44. A tubular spacer 84 is placed on each stud, a resilient sealing ring 67 placed completely around the trunnion, and an annular flange 86 having apertures therein placed to receive the studs 82. A second spacer 88 coextensive with stud 82 defines a void 68 having a connecting passageway 72 to a source of high pressure air whereby said void 68 may be continuously supplied with a quantity of air at a pressure in excess of that within the heat exchanger.

A second annular flange 92 similar to flange 86 is placed over studs 82. At this point, a spacer 94 having nuts 96 welded to the opposite ends thereof is threaded to the end of studs 82, while a resilient packing ring 66 is placed in the space above the flange 92. A third annular flange 98 having apertures therein is aligned with the spacers 94 to permit a bolt 102 threaded at opposite ends thereof to be extended through one of the apertures and turned into nut 96 to produce a cover that contains the packing 66. A sealing flange 104 of relatively soft material such as aluminum or plastic has a central opening therein that is substantially larger than bolt 102 whereby the sealing flange may slide laterally on flange 98 to readily deform and accommodate relative movement between the trunnion 16 and the sleeve 48.

The sealing flange 104 is biased against the annular flange 98 by a spring means 106 encircling the bolt 102 and held in a compressed condition by adjusting nut 108. By this arrangement, the fluid pressure within the space 68 is further contained by the sealing flange 104 whereby fluid leakage therethrough is reduced to a minimum.

The invention described herein and illustrated in the accompanying drawing is believed to admit to various alterations and modifications within the ability of persons skilled in the art. Therefore, all such modifications and alterations are to be considered to lie within the spirit and scope of the appended claims.

We claim:

1. Rotary regenerative heat exchange apparatus having a mass of heat absorbent material disposed for rotation concentrically about a vertical rotor post, a housing surrounding said rotor including end plates at opposite ends of the rotor having apertures that direct the flow of heating fluid and fluid to be heated through the rotor, bearing means supporting the rotor for rotation about its vertical axis, a guide bearing intermediate the upper end of the rotor post and the rotor housing adapted to preclude radial movement of the rotor post, a housing for the guide bearing supported by the rotor post and adapted to move axially with thermal expansion of the rotor, sector plates intermediate an end of the rotor and the end plates of the rotor housing adapted to separate the heating fluid from the fluid to be heated, post sealing means intermediate the radially inner end of the sector plates and the rotor post precluding the flow of fluid therebetween, and support means depending from the bearing housing adapted to simultaneously support the post sealing means and the inboard ends of the sector plates for independent radial and axial movement whereby the post sealing means and the sector plates may move freely in response to thermal variations of the rotor.

2. Rotary regenerative heat exchange apparatus as defined in claim 1 including means at the outboard ends of the sector plates adapted to connect said sector plates to the rotor housing whereby the inboard ends only may be moved axially with respect to the rotor housing.

3. Rotary regenerative heat exchange apparatus as defined in claim 1 wherein the post sealing means comprises a cylindrical tube concentric with the rotor post, said cylindrical tube having one end thereof slidably supporting the inboard ends of the sector plates while the opposite end thereof is supported by the end of the rotor.

4. Rotary regenerative heat exchange apparatus as defined in claim 3 wherein the concentric cylindrical tube and the rotor post define an annulus therebetween, and packing material carried in said annulus adapted to preclude the passage of fluid therethrough.

5. Rotary regenerative heat exchange apparatus as defined in claim 4 wherein the packing material in said annulus comprises independent annular masses of packing with an annular void therebetween.

6. Rotary regenerative heat exchange apparatus as defined in claim 5 including a source of high pressure air, and duct means connecting said void to the source of high pressure air.

7. Rotary regenerative heat exchange apparatus as defined in claim 6 where the annular mass of packing adjacent the rotor has less resistance to flow therethrough than the annular mass of packing material axially spaced therefrom whereby pressurized air in said void will flow through the path of least resistance back into the rotor housing when pressure in said void exceeds that in said housing.

* * * * *